US007427574B2

(12) United States Patent
Allen

(10) Patent No.: US 7,427,574 B2
(45) Date of Patent: Sep. 23, 2008

(54) NON-WOVEN WASH CLOTH

(75) Inventor: Jennifer Allen, Crystal Lake, IL (US)
(73) Assignee: Sage Products, Inc., Cary, IL (US)

( * ) Notice: Subject to any disclaimer, the term of this patent is extended or adjusted under 35 U.S.C. 154(b) by 249 days.

(21) Appl. No.: 11/208,079

(22) Filed: Aug. 19, 2005

(65) Prior Publication Data

US 2007/0042666 A1 Feb. 22, 2007

(51) Int. Cl.

| | |
|---|---|
| ***D04H 1/40*** | (2006.01) |
| ***D04H 1/46*** | (2006.01) |
| ***B32B 27/36*** | (2006.01) |
| *A61M 35/00* | (2006.01) |
| *A01N 25/34* | (2006.01) |

(52) U.S. Cl. ..... 442/402; 428/212; 424/443; 604/290; 15/210.1

(58) Field of Classification Search ..... 442/402, 442/403, 405, 407, 415, 416, 334; 428/212, 428/213, 220; 424/443, 402, 404, 405; 604/289, 604/290; 15/104.93, 104.94, 208, 209.1, 15/210.1

See application file for complete search history.

(56) References Cited

U.S. PATENT DOCUMENTS

| | | | | |
|---|---|---|---|---|
| 5,928,973 | A * | 7/1999 | Daniel et al. | 442/407 |
| 6,029,809 | A * | 2/2000 | Skiba et al. | 206/210 |
| 7,066,916 | B2 * | 6/2006 | Keaty et al. | 604/290 |
| 2004/0228758 | A1 * | 11/2004 | Keaty et al. | 422/28 |
| 2004/0230168 | A1 * | 11/2004 | Keaty et al. | 604/290 |
| 2006/0019571 | A1 * | 1/2006 | Lange et al. | 442/402 |
| 2006/0079143 | A1 * | 4/2006 | Phan et al. | 442/59 |
| 2006/0233868 | A1 * | 10/2006 | Keaty et al. | 424/443 |

FOREIGN PATENT DOCUMENTS

| | | | |
|---|---|---|---|
| JP | 04049229 | A * | 2/1992 |
| JP | 2003020597 | A * | 1/2003 |
| JP | 2004159742 | A * | 6/2004 |
| JP | 2005013309 | A * | 1/2005 |

* cited by examiner

*Primary Examiner*—Cheryl Juska
(74) *Attorney, Agent, or Firm*—Barnes & Thornburg LLP

(57) ABSTRACT

A non-woven washcloth formed from a blend of two different size polyester fibers, the majority of which have a length about half of that of the minority. The washcloth has good absorbing and holding properties for a solution containing chlorhexidine gluconate, while also releasing said chlorhexidine gluconate when wiped on skin.

20 Claims, 1 Drawing Sheet

NON-WOVEN WASH CLOTH

BACKGROUND OF THE INVENTION

This invention relates to non-woven fabrics, and in particular to a non-woven washcloth having blend of two sizes of polyester fibers.

The assignee of the present application, Sage Products, Inc. of Cary, Ill., has been marketing and selling, for years, a needle-punched, nonwoven product sold under Sage's trademark "COMFORT BATH". The nonwoven washcloth of the Comfort Bath product is a blend of two fibers, lyocell fibers and polyester fibers. U.S. Pat. No. 5,928,973 discloses a similar-such product.

Sage Products, Inc. has also developed a disinfectant delivery system and method of providing alcohol-free disinfection, and is the owner of two co-pending U.S. patent applications related thereto, Ser. No. 10/435,898, filed May 12, 2003 and Ser. No. 10/435,902, also filed May 12, 2003 now U.S. Pat. No. 7,066,916. The disclosures of these two applications are incorporated herein by reference.

One of the ingredients of the disinfectant delivery system of the two incorporated applications is chlorhexidine gluconate (CHG). CHG is a highly effective broad-spectrum topical antiseptic. It is effective against both gram-positive and gram-negative bacteria, and exhibits the property of persistence, providing protection for hours beyond an initial application. CHG exhibits a cumulative property that improves efficacy after multiple applications, and is well tolerated by human skin. It is considered to be a premier topical antiseptic ingredient used by the healthcare community.

A problem with CHG and CHG blends is that they tend to chemically or mechanically bind with certain fibers. One such fiber is lyocell which, when used in a blend such as that of U.S. Pat. No. 5,928,973, results in the CHG being bound and not properly released. Lyocell is hydrophyllic. Thus, a washcloth while having appropriate properties of wet strength, softness and loft is needed that will not allow CHG to chemically or mechanically bind to the fiber, as with lyocell, but rather be released in a controlled manner. Polyester fiber based non-woven washcloths exhibit an ability to fully release CHG since the fibers are hydrophobic in nature.

SUMMARY OF THE INVENTION

The invention is directed to a non-woven fabric comprising sixty percent to eighty percent by weight of a first polyester fiber having a length of from about 1 to 3 inches, with 1.5 inches preferred and a denier of from about 1.2 to 2, with 1.2 preferred. The balance is a second polyester fiber having a length of from about 3.0 to 4.0 inches, with 3.0 inches preferred, and a denier of from about 4 to 5, with 4.75 preferred. The fabric is formed by subjecting the fibers to carding, crosslapping and mechanical entanglement to produce a fabric with inter-engaged fibers.

In accordance with a preferred form of the invention, the resulting fabric has a weight of from about 3.8 to about 5.8 ounces per square yard. The preferred weight is 4.8 ounces per square yard. While mechanical entanglement may be accomplished by any well-known process of mechanically entangling fibers, it is preferred that mechanical entanglement is accomplished by needle punching.

BRIEF DESCRIPTION OF THE DRAWING

The invention is described in greater detail in the following description of an example embodying the best mode of the invention, taken in conjunction with the single drawing FIGURE, in which.

DESCRIPTION OF AN EXAMPLE EMBODYING THE BEST OF THE INVENTION

Figure 1:
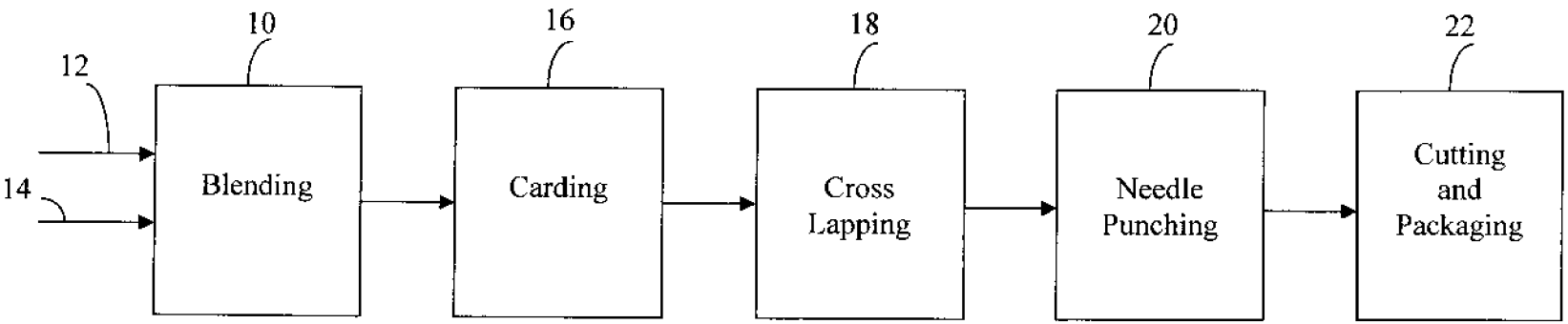
FIG. 1 is a block diagram illustrating the steps in formation of a washcloth according to the invention.

FIG. 1 illustrates the steps of forming a non-woven fabric according to the invention. Each step of the process according to the invention can be performed by conventional apparatus, and therefore each step is not described in greater detail.

In a first step 10, two different size polyester fibers, described in greater detail below, are introduced at 12 and 14, and are blended. The blended fibers are then passed to a second stage, where the fibers are carded at 16. Thereafter, the carded fibers are subjected to crosslapping at 18, and following crosslapping, the fibers are then needle punched at 20. Finally, the resulting fabric is cut into individual washcloths, and appropriate solutions are added and the washcloths are packaged in individual packages at 22, for subsequent use by healthcare practitioners.

The fibers introduced at 12 and 14 are two different polyester fibers. The first fiber is a polyester fiber of from about 1.0 inches to 1.3 inches in length, with 1.5 preferred and a denier of about 1.2 to 2, with 1.2 preferred. This fiber is added in an amount of from 60% to 80% by weight. The second polyester fiber introduced at 14 has a length of from about 3.0 inches to 4.0 inches, with 3.0 preferred, and a denier of from about 4 to 5, with 4.75 preferred, and comprises the balance of what is blended at 10, thus from 40% to 20% by weight.

The resulting fabric, after needle punching at 20, has a tensile strength of a minimum of 27 lbs. per inch in the machine direction. The thickness is from 0.055 inches to about 0.125 inches, with a thickness of 0.090 inches being preferred. The weight is from about 3.8 ounces per square yard to about 5.8 ounces per square yard, with 4.8 ounces per square yard being preferred.

The fabric, when cut into washcloths and packaged with a solution including CHG, provides a washcloth that is soft, but doesn't break the skin. It is sufficiently robust to clean the top layer of cells from the skin so that the CHG solution can be applied from the washcloth to the skin to disinfect, without the CHG being bound to the material of the washcloth.

Various changes can be made to the invention without departing from the spirit thereof or scope of the following claims.

What is claimed is:

1. A non-woven fabric in combination with a solution containing chlorhexidine gluconate, comprising 60% to 80% by weight of a first polyester fiber having a length of from about 1.0 inches to 3.0 inches and a denier of from about 1.2 to 2.0, and 40% to 20% by weight of a second polyester fiber having a length of from about 3.0 inches to 4.0 inches and a denier of from about 4.0 to 5.0, said fabric being formed by subjecting said fibers to carding, crosslapping and mechanical entanglement to produce a fabric with inter-engaged fibers, and said fabric absorbing and holding the solution containing chlorhexidine gluconate and releasing the chlorhexidine gluconate when wiped on skin.

2. The fabric according to claim 1, in which the length of the first polyester fiber is about 1.5 inches.

3. The fabric according to claim 1, in which the denier of the first polyester fiber is about 1.2.

4. The fabric according to claim 1, in which the length of the second polyester fiber is about 3.0 inches.

5. The fabric according to claim 1, in which the denier of the second polyester fiber is about 4.75.

6. The fabric according to claim 1 which has a weight of from about 3.8 to about 5.8 ounces per square yard.

7. The fabric according to claim 6 which has a weight of 4.8 ounces per square yard.

8. The fabric according to claim 1 in which said mechanical entanglement is needle punching.

9. The fabric according to claim 1 having a thickness from about 0.055 inches to about 0.125 inches.

10. The fabric according to claim 9 in which the thickness is 0.090 inches.

11. A non-woven fabric in combination with a solution containing chlorhexidine gluconate, comprising 60% to 80% by weight of a first polyester fiber having a length of from about 1.0 inches to 3.0 inches and a denier of from about 1.2 to 2.0, and 40% to 20% by weight of a second polyester fiber having a length of from about 3.0 inches to 4.0 inches and a denier of from about 4.0 to 5.0, said fabric being formed by subjecting said fibers to carding, crosslapping and mechanical entanglement to produce a fabric with inter-engaged fibers, and said fabric not chemically or mechanically binding with chlorhexidine gluconate of the solution containing chlorhexidine gluconate.

12. The fabric according to claim 11, in which the length of the first polyester fiber is about 1.5 inches.

13. The fabric according to claim 11, in which the denier of the first polyester fiber is about 1.2.

14. The fabric according to claim 11, in which the length of the second polyester fiber is about 3.0 inches.

15. The fabric according to claim 11, in which the length of the second polyester fiber is about 4.75.

16. The fabric according to claim 11 which has a weight of from about 3.8 to about 5.8 ounces per square yard.

17. The fabric according to claim 16 which has a weight of 4.8ounces per square yard.

18. The fabric according to claim 11 in which said mechanical entanglement is needle punching.

19. The fabric according to claim 11 having a thickness from about 0.055 inches to about 0.125 inches.

20. The fabric according to claim 19 in which the thickness is 0.090 inches.

* * * * *